United States Patent [19]

Thrush

[11] Patent Number: 4,495,387

[45] Date of Patent: Jan. 22, 1985

[54] ROTARY SELECTOR SWITCH

[75] Inventor: Roger L. Thrush, Mansfield, Ohio

[73] Assignee: White Consolidated Industries, Inc., Cleveland, Ohio

[21] Appl. No.: 430,806

[22] Filed: Sep. 30, 1982

[51] Int. Cl.[3] ..... H01H 19/00

[52] U.S. Cl. ..... 200/6 B; 200/6 BB; 200/303

[58] Field of Search ..... 200/6 B, 6 BA, 6 BB, 200/6 C, 153 LA, 153 LB, 284, 283, 303

[56] References Cited

U.S. PATENT DOCUMENTS

| | | | |
|---|---|---|---|
| 2,739,208 | 3/1956 | Ullrich | 200/6 BB |
| 2,813,158 | 11/1957 | Hutt | 200/6 |
| 3,251,956 | 5/1966 | Rasor et al. | 200/14 |
| 3,502,835 | 3/1970 | Batcheller | 200/154 |
| 3,652,811 | 3/1972 | Barney | 200/5 EB |
| 3,748,419 | 7/1973 | Torrey et al. | 200/155 R |
| 3,778,566 | 12/1973 | Gusaras | 200/14 |
| 4,025,738 | 5/1977 | Erwin et al. | 200/6 B |
| 4,059,738 | 11/1977 | Mongeau | 200/6 B |
| 4,133,990 | 1/1979 | Wanner et al. | 200/6 B |
| 4,182,939 | 1/1980 | Feaster | 200/17 R |
| 4,256,358 | 3/1981 | Genz | 339/95 D |

*Primary Examiner*—J. R. Scott

*Attorney, Agent, or Firm*—Pearne, Gordon, Sessions, McCoy, Granger & Tilberry

[57] ABSTRACT

A multicircuit rotary selector switch having no external terminals is disclosed. A two-part interlocking housing journals a user-rotatable shaft carrying a stack of coaxially oriented, multilobed cam discs, each disc defining a tier level within the housing. Engageable with each disc and lying in its tier level is a pair of elongated movable switching elements each having a wire gripping end portion, a moving contact end portion, and an intermediate cam follower portion riding the lobes of its associated cam disc, each movable switching element being configured as a third class lever. One or more fixed switching elements, each including a contact portion and a wire gripping portion, are located adjacent the contact end portions of each of the moving switching elements. Portions of the fixed and movable switching elements are sandwiched between the two parts of the housing to maintain them in proper position relative to each other and to the cam disc stack.

14 Claims, 10 Drawing Figures

10
11
12
14
16
20
24
30
31
40
43
50
51
52
52a
53
55
56
57
58
60
62
64

FIG. 9
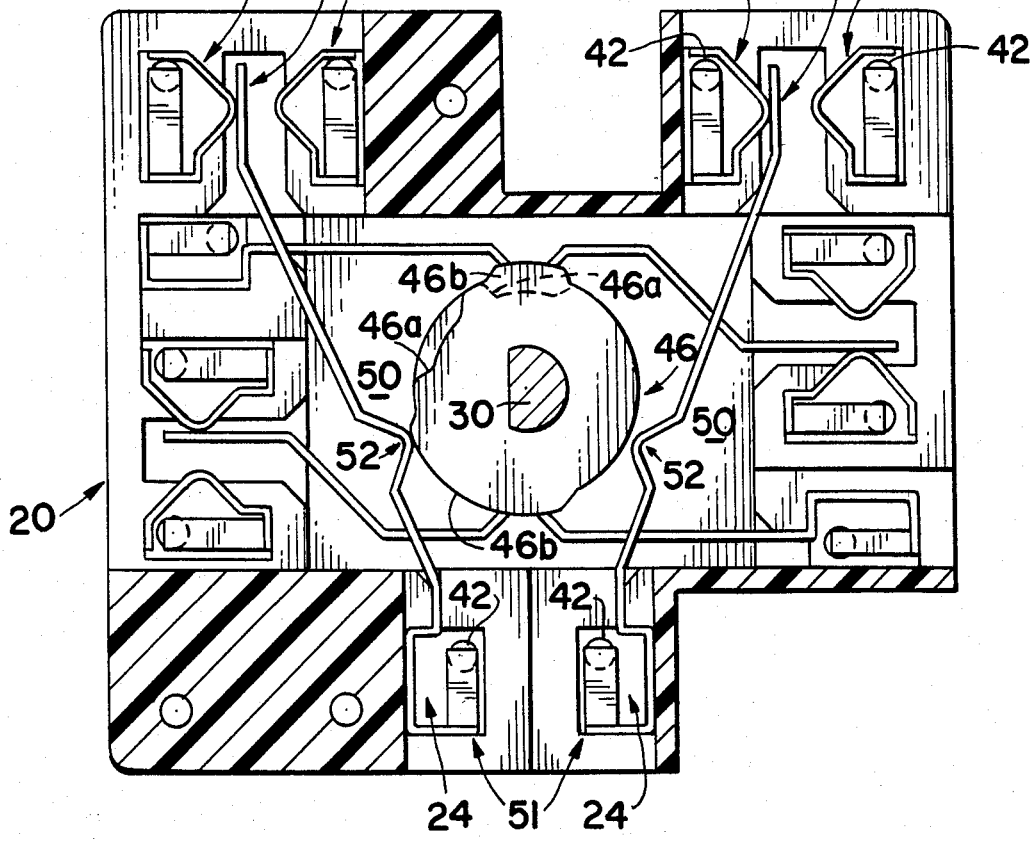
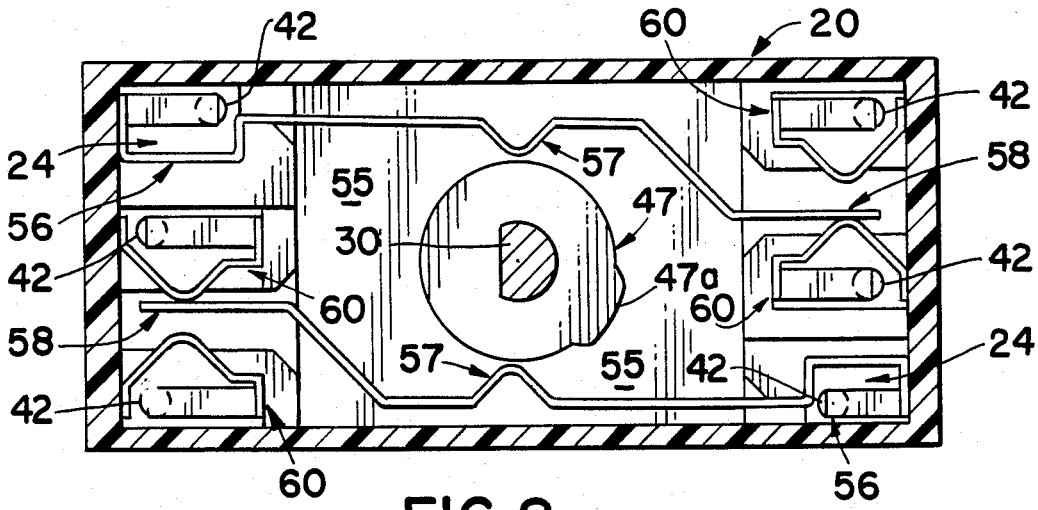
FIG. 8

ROTARY SELECTOR SWITCH

BACKGROUND OF THE INVENTION

The present invention relates in general to multicircuit electric switches, and more particularly to low cost selector switches used to control domestic appliances such as clothes washers and dryers, cooking ranges, and dishwashers.

Such a selector switch typically contains a plurality of switching elements actuated by a single control knob rotated by a user to select and establish the operating mode of an appliance associated with the switch. For example, such a switch mounted on a cooking range control panel interconnects heating elements and related control and power elements of the range, to provide a baking mode, a normal broiling mode, a speed broiling mode, or a self-cleaning oven mode.

It is well known in the art that the domestic appliance manufacturing business is extremely cost-competitive. Thus, there is a continuing need for cost reduction of components used in manufacturing such appliances.

A selector switch of the type noted, while required to be as low as possible in cost, must also meet stringent reliability and longevity requirements, since the typical domestic appliance incorporating such a selector switch may be in daily use for many years.

The cost of the selector switch includes not only the cost of the materials used and the cost of labor in forming the parts of the switch, but also the cost of assembling the parts to form the switch. It is also important that the selector switch be connectable in circuit in a fast and facile manner to minimize assembly costs of the appliance in which it is incorporated.

In one aspect, the present invention provides a highly reliable and long-lived, cost effective switch that can be readily connected in circuit without the need for terminals fastened to the wire ends to be mechanically and electrically connected to the switch.

In a further aspect, the present invention provides a selector switch composed in part of a plurality of identical components easily manufactured from conventional stock materials.

In a still further aspect of the present invention, subassembly components of the switch are modular in nature so as to provide for a more or less complex switch, depending upon the number of modulelike subassemblies incorporated into the switch.

SUMMARY OF THE INVENTION

The present invention provides a rotary selector switch having no external terminals. At least one cam member is fixed to and carried on a rotatable shaft. A switching means, actuated by the cam upon rotation of the shaft, includes at least one fixed element having a wire gripping portion and a contact portion. The switching means further includes at least one elongated movable element having a wire gripping end portion and a contact end portion, the end portions being interconnected by an intermediate cam follower portion engageable with and driven by the cam member. The movable element is configured as a third class lever with its wire gripping end portion being located generally at the lever fulcrum point. Rotation of the cam member causes the contact portion of the fixed element and the contact end portion of the movable element to engage and disengage with each other at one or more predetermined rotational positions of the shaft. A casing rotationally supports the shaft and provides a closed chamber for housing the cam member and the switching means. Apertures in the casing permit the insertion of wire ends for lockable engagement with the wire gripping portions and the wire gripping end portions of the switch means.

The fixed and movable elements are preferably formed of single pieces of deformed copper-based alloy metal having springlike characteristics. Further, the casing is preferably formed of two interlocking parts that sandwich portions of the fixed and moving elements to maintain them in proper position relative to each other and the cam member.

A multicircuit selector switch is provided when a stack of cam discs, constituting the cam member, is associated with a plurality of fixed and movable elements sandwiched between the casing parts to provide, for example, six separate single pole, double-throw switches actuated by a single cam disc stack rotatable through 360 degrees.

A fuller understanding of the invention may be had by referring to the following description and claims, taken in conjunction with the accompanying drawings.

BRIEF DESCRIPTION OF THE DRAWINGS

FIG. 8 is a top plan view of the selector switch of FIG. 6, taken along line 8—8 of FIG. 6;

FIG. 9 is a top plan view of the selector switch of FIG. 6, taken along line 9—9 of FIG. 6.

DETAILED DESCRIPTION OF THE PREFERRED EMBODIMENTS

Figures 1, 2, 3, 4:
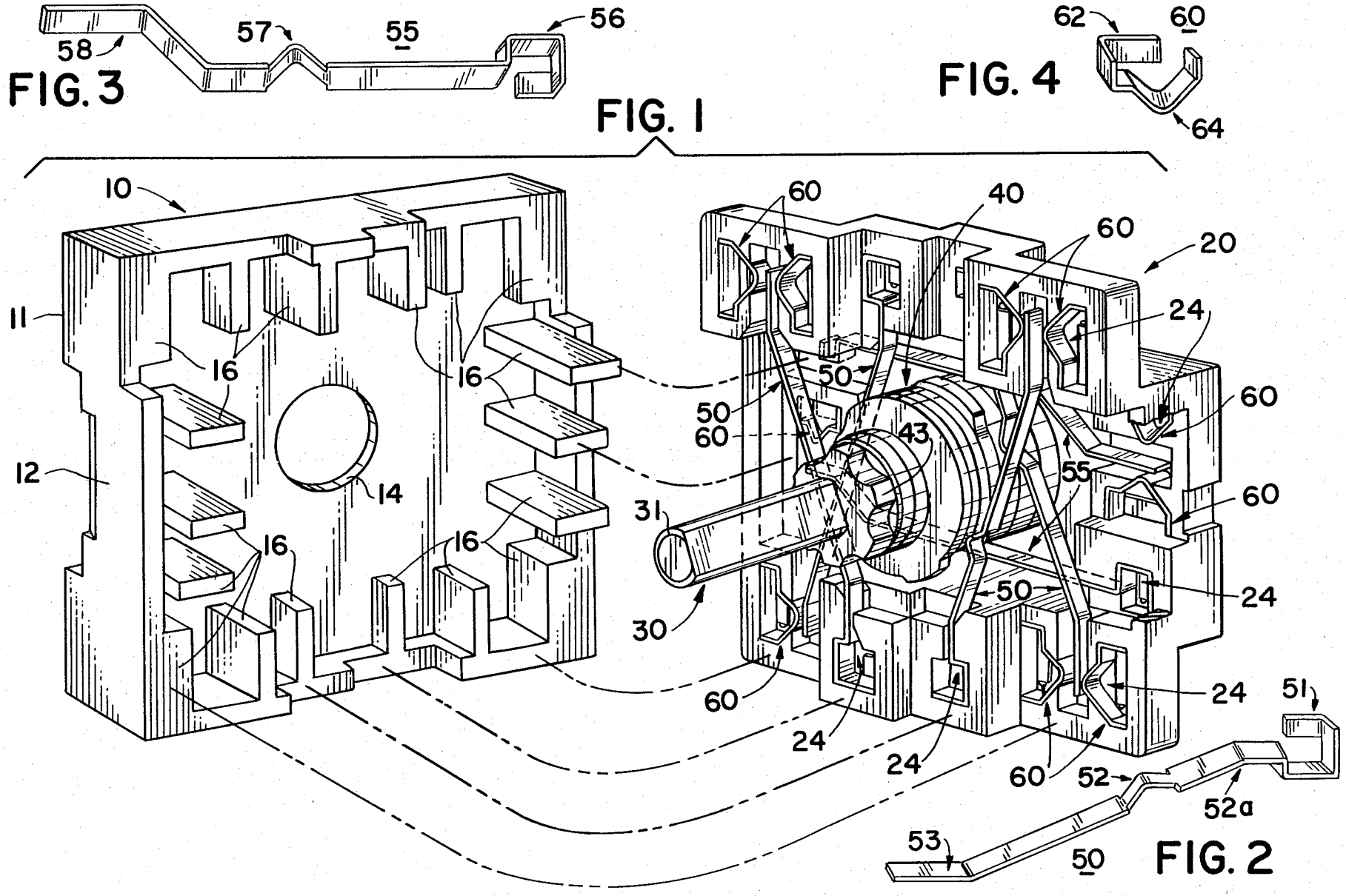
FIG. 1 is a partially exploded, perspective view of the main portions of a rotary selector switch in accordance with the present invention.
FIGS. 2, 3, and 4 are perspective views of switching elements incorporated into the switch of FIG. 1.

In accordance with the present invention, and in particular with reference to FIG. 1, there is illustrated a multicircuit rotary selector switch, the switch including a two-part housing or casing comprised of a top half or cover member 10 and a bottom half or base member 20, the members 10,20 preferably being molded from suitable electrical insulating materials. The cover and base members 10, 20, when fitted together in interlocking relationship, comprise a boxlike casing having an interior closed chamber containing a switching means functioning as a domestic appliance control as discussed earlier. The chamber encloses the major portion of a user-rotatable shaft 30 upon which are rotationally and axially fixed a stack of coaxially oriented, multilobe cam members or discs 40. A distal end 31 of the shaft 30 extends through a generally central aperture defined by a circular wall 14 provided by the central portion of the cover member 10. The circular wall 14 acts as a bushinglike bearing surface to rotatably support the shaft 30 within the chamber provided by the interlocked cover and base members 10,20, the end of the shaft 30 opposite its distal end 31 being journaled in a suitable aperture in the central portion of the base member 20, as will be subsequently illustrated in detail. At the upper end (leftward end as viewed in FIG. 1) of the stack of cam discs 40, there is provided a detent element 43 rotationally and axially fixed in position on the shaft 30, the detent element 43 projecting through the aperture provided by the circular wall 14 for engagement with additional detent elements located outside the closed chamber provided by the interlocked cover and base members 10,20. The function of the detent element 43 and the other detent elements associated with it will be discussed subsequently.

Also provided within the closed chamber of the box-like casing, and mounted on the base member 20, are a plurality of electrical switching elements comprised of elongated, movable switching elements of the angle type 50, elongated movable switching elements of a a linear type 55, and fixed switching elements 60 associated with both the angle type switching elements 50 and linear type switching elements 60.

The switching elements 50, 55, 60 can be seen most clearly in FIGS. 2, 3, and 4. With particular reference to FIG. 2, an elongated movable switching element of the angle type 50 is illustrated. This switching element 50 includes a terminal end portion in the preferred form of a wire gripping end portion 51 and a moving contact end portion 53, such end portions being joined by an intermediate cam follower portion 52. In accordance with the present invention, the wire gripping portion 51 is held generally stationary, while the intermediate cam follower portion 52 is engaged and driven by one or more lobes on the cam disc stack (see FIG. 1). Under such camming action, the moving contact end portion 53 swings back and forth to and away from the fixed contact elements 60, to be subsequently discussed in greater detail. The elongated movable switching element 50 is of the angle type, in that it includes a bend at location 52A so as to provide a slight angle in the intermediate cam follower portion 52, such angle being of a predetermined degree for purposes to be further discussed.

With particular reference to FIG. 3, there is illustrated an elongated, movable switching element of the linear type 55. Like the element 50 illustrated in FIG. 2, the element 55 includes a terminal end portion in the preferred form of a wire gripping end portion 56 and a moving contact end portion 58, the end portions 56,58 being joined by an intermediate cam follower portion 57. Unlike the element 50 of FIG. 2, the element 55 does not include a bend, such as at location **52*a* of FIG. 2, wherein the element 50 is thus more linear than the angled element of FIG. 2. Like the element 50 of FIG. 2, the wire gripping end portion 56 of element 55 is held in fixed position while the intermediate cam follower portion 57 is engaged and driven by one or more lobes on the stack of cam discs 40 (see FIG. 1) wherein the moving contact 58 can engage and disengage with the fixed contact elements 60**.

FIG. 4 illustrates a fixed switching element 60 suitable for use in conjunction with either of the elongated switching elements 50,55 illustrated in FIGS. 2 and 3. The fixed switching element 60 includes a terminal portion in the preferred form of a wire gripping portion 62 and an adjacent contact portion 64. The contact portion 64 is engageable with the moving contact portions 53,58 of the movable switching elements 50,55. The switching elements 50,55,60 are all formed of thin, relatively narrow strips of copper-based sheet metal having springlike characteristics. In accordance with the invention, only three basic types of switching elements, as illustrated in FIGS. 2, 3, and 4, need be used to manufacture a relatively complex multicircuit switch, as will now be discussed.

With further reference to FIG. 1, the fixed switching elements 60 are received in a plurality of recesses 24 provided about the periphery of that face of the base element 20 that engages with the cover member 10. The recesses 24 loosely receive the fixed switching element 60 so that they can resiliently move to a limited degree against forces applied to them by wires that are inserted into the casing, in a manner to be subsequently illustrated, and by moving contact end portions 53,58 discussed earlier with regard to FIGS. 2 and 3. In similar fashion, the wire gripping end portions 51,56 (see FIGS. 2 and 3) of the elongated movable switching elements 50,55 are also received in recesses 24. As shown in FIG. 1, the intermediate cam follower portions 52,57 (see FIGS. 2 and 3) extend across the closed chamber provided by the interlocked cover and base members 10,20.

FIG. 1 illustrates a relatively complex multicircuit switch having six single-pole, double-throw switching elements all actuated by the multilobed stack of cam discs 40 as it is rotated through positions by the user twisting the shaft 30. All of the switching elements 50,55 are biased toward the shaft 30, although this would not be necessary where single-throw switches are utilized. To maintain the wire gripping end portions 51,56 of the elongated switching elements 50,55, and the fixed stationary switching elements 60, within the recesses 24 of the base member 20, a plurality of abutting portions 16 of the cover member 10 are provided. When the housing halves constituted by the cover 10 and the base 20 are interlocked, the abutting portions 16 engage and loosely hold in place the fixed switching elements 60 and the wire gripping end portions 51,56 (see FIGS. 2 and 3) in the recesses 24. In effect, the cover and base member 10,20 sandwich the switch element portions 51,56 and 62. As can be seen in FIG. 1, the switching elements 50,55,60 are thus held in position relative to each other and to the stack of cam discs 40. It can also be seen that each movable element 50,55 and its associated pair of fixed elements 60 lie in a plane defined by a unique axial portion of the stack of cam discs 40, so that the movable elements 50,55 are spaced from each other along the axis of the cam stock by distances suitable for electrical isolation purposes. As an operator rotates the shaft 30 through 360 degrees, all of the six switches (constituted by elements 50,55,60) will open or close at predetermined rotational positions depending upon the predetermined positions of the cam lobes on the stock of cam discs 40.

It is to be noted that while the switch of FIG. 1 illustrates six single-pole, double-throw switches, it is clearly contemplated that more or less switching elements could be utilized depending upon the requirements and complexity of the controlled circuitry. Also, the exact dimensions, composition, and metal gauge of the switching elements 50,55,60 would depend on the voltages and currents to be controlled.

Figure 5:
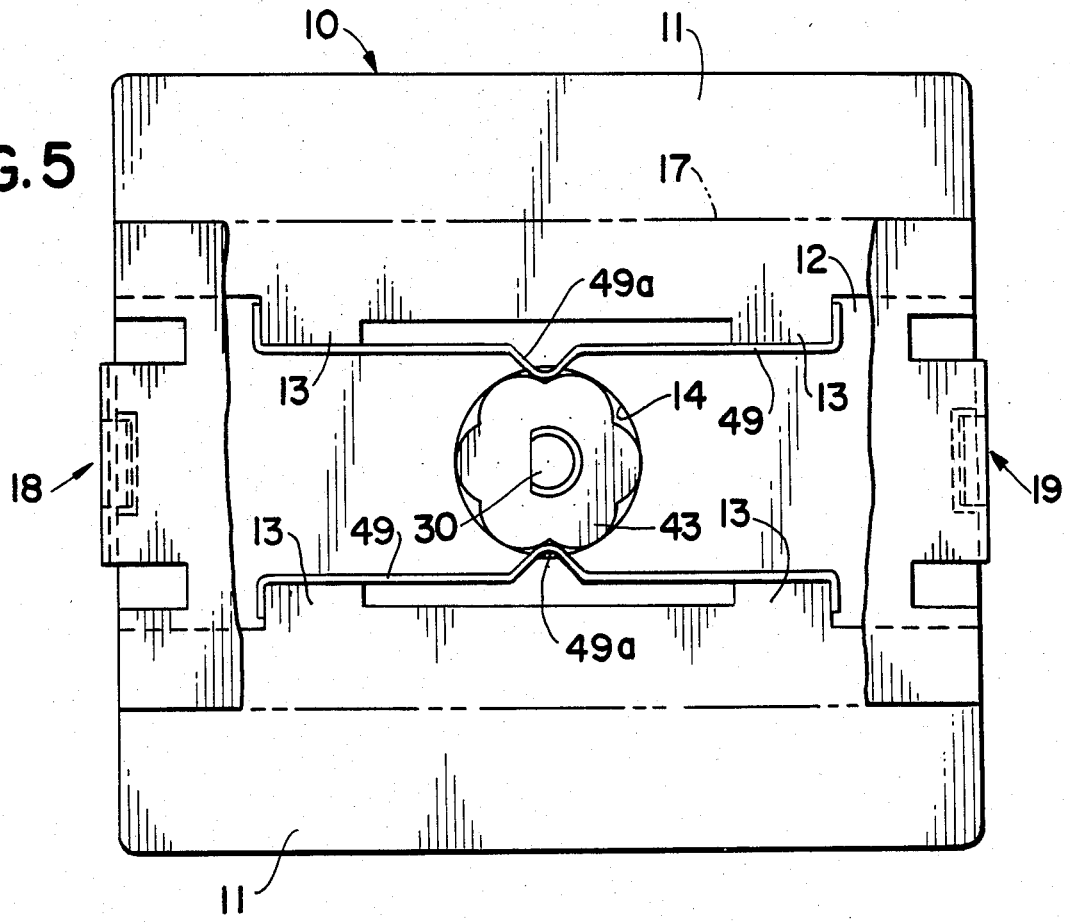
FIG. 5 is a top plan view of the selector switch in accordance with the present invention, with portions cut away.
Figure 6:
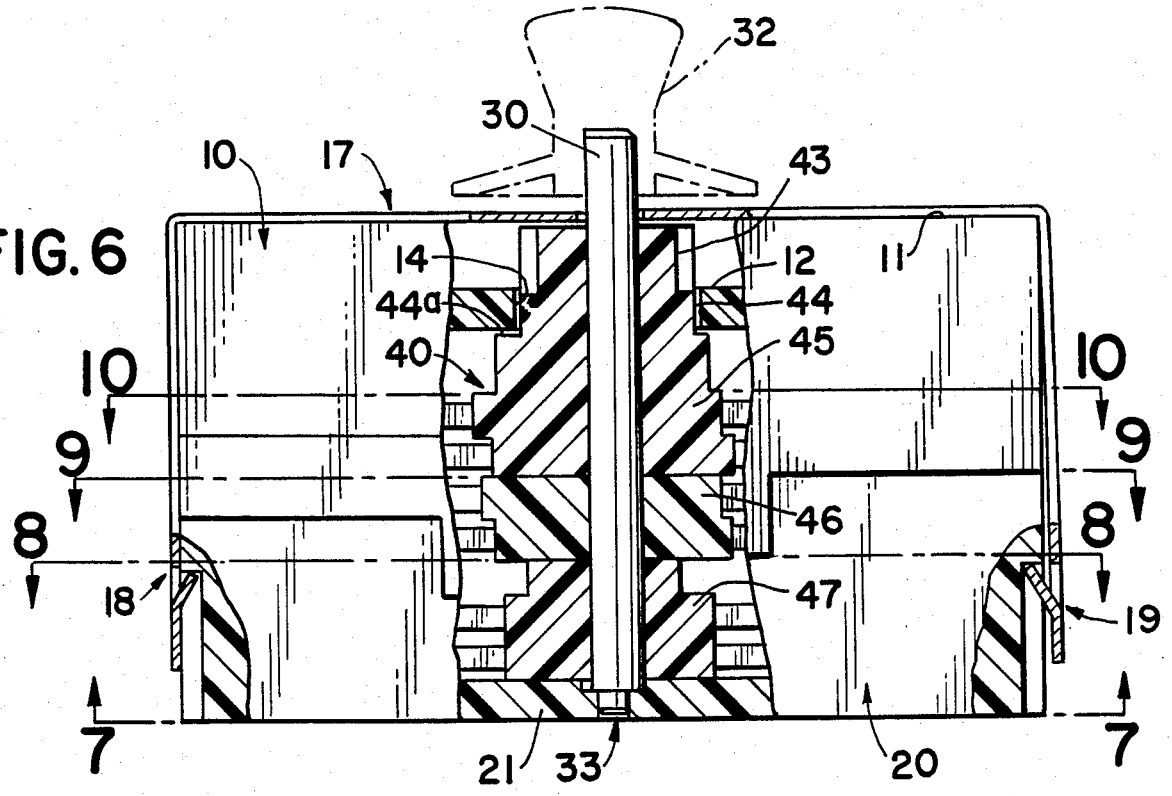
FIG. 6 is a side elevation view of the switch of FIG. 5, with portions cut away.

With reference to FIG. 5, there is illustrated a top plan view for an assembled switch in accordance with the present invention, the cover member 10 including an upper surface 11 and a recessed surface 12, the surfaces lying in planes parallel to each other. The surfaces 11 and 12 can also be seen in FIG. 6, which is a side elevation view of the switch of FIG. 5, with portions cut away. As illustrated by FIGS. 5 and 6, the detent element 43 projects above the surface 12 for engagement with a pair of opposed, springlike detent elements 49 which rest on the recessed surface 12 and have their ends engaging stop portions 13 of the cover member 10. Provided at the central portion of the springlike detent elements 49 are opposed projections 49*a* that are springbiased toward each other, and thus against the interposed, outer periphery of the rotatable detent element 43. The detent element 43 contains a plurality of projections or lobes circumferentially equidistantly spaced about the periphery of element 43. Projections 49*a* lock into the valleys between the lobes of detent element 43 to releasably retain the element 43 at one of its rotational positions. As a user rotates the shaft 30, the shaft will lock at one of six positions, as can be seen in FIG. 5 to provide a six-position rotary switch. It is to be noted that more or less locking positions may be provided, and that the six-position detent mechanism of FIG. 5 is merely an example.

A preferred method of locking the cover and base members 10,20 into interlocking assembled relationship with each other is to use a snap-on type spring steel clip having first and second locking ears 18,19 that project against opposed sides of the base member 20 to lockably engage undercut portions thereof, as most clearly indicated in FIG. 6. The spring steel clip 17 is of sufficient width as viewed in FIG. 5, and as shown in phantom, to completely cover the recessed surface 12 so as to contain and maintain the spring detent elements 49 in their proper position, as illustrated.

With particular reference to FIG. 6, the shaft 30 is elongated and has its lower end 33 of reduced diameter journaled in a suitable central aperture in the bottom wall 21 of the base member 20. The shaft 30 is of non-circular cross section along substantially all of its length wherein corresponding non-circular cross section bores or apertures in the stack of cam discs 40 can be rotatably locked in position on and can be received by the shaft 30.

The stack of cam discs 40 is comprised of an upper cam disc 45, a middle or intermediate cam disc 46, and a lower or bottom cam disc 47. Each of the cam discs 45, 46, 47 drives a pair of movable switching elements (of either or both types 50,55, see FIG. 1), as will be illustrated further in subsequent figures. It is to be noted that while only three cam discs are illustrated in FIG. 6, more or less cam discs could be provided, including a single cam disc for each of the six switching elements or a unitary, integrally formed cam disc actuating all six elements. By using a plurality of cam discs having different lobe placement, it is possible to provide different programs for different switches by simply changing the position or location of different cam discs. As shown in FIG. 6, the switch in accordance with the invention has multiple tiers, a first or upper tier being defined as that area generally immediately above the line 9—9 and below line 10—10 of FIG. 6. An intermediate tier is located between lines 9—9 and 8—8 of FIG. 6, while a bottom tier is located below line 8—8 of FIG. 6. Associated with each of the tier levels is a pair of switching elements that are actuated by the cam disc within each tier level. Also provided at the upper end of the cam disc 45 is a circular bearinglike surface 44 that is engageable with the circular bushinglike wall 14 discussed earlier in regard to FIG. 1. Also provided at the upper area of the cam disc 45 is a radially extending surface 44*a* defining a diameter larger than the diameter of the aperture defined by wall 14 so that the surface 44*a* acts as a stop to preclude upward movement of the cam disc stack 40 so as to maintain the lower end 33 of the shaft 30 in its journaled position, as illustrated in FIG. 6. It is to be noted that the discs 45, 46, and 47 are press-fitted onto the shaft as is a suitable control knob 32, the shaft 30 extending through an aperture in the spring steel clip 17. The switch can be mounted using suitable fasteners that engage the clip 17.

Figure 7:
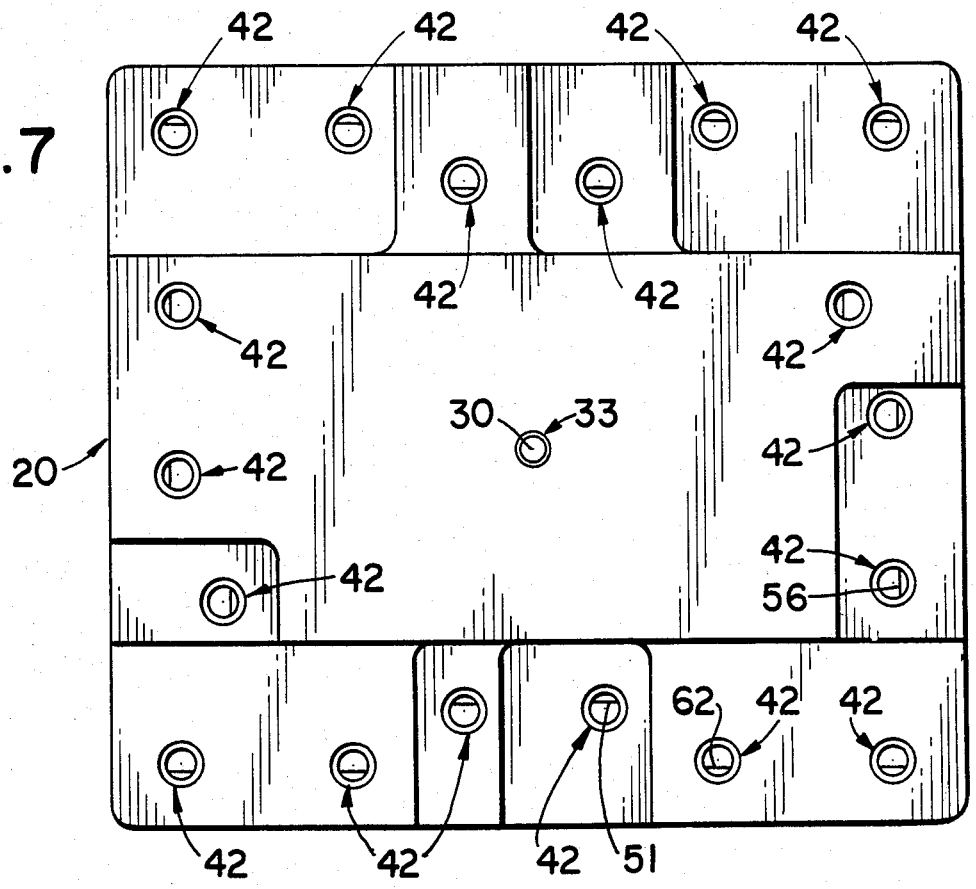
FIG. 7 is a bottom plan view of the selector switch of FIG. 6, taken along line 7—7 of FIG. 6.

FIG. 7 is a bottom view of the boxlike base member 20. The lower end portion 33 of the shaft 30 can be seen, as can a plurality of apertures 42 through which the end of non-insulated wires are pushed for locking, self-gripping engagement with the switching element portions 51, 56, and 62 as illustrated in FIGS. 2, 3, and 4. It can be seen that no external terminals are provided on the outer surface of the base member 20. It can also be seen that the switching element wire gripping terminal portions 51, 56, and 62 are generally circumferentially distributed about the axis of rotation of the shaft 30, such switching element portions extending about the peripheral edge of the four-sided face of the base member illustrated in FIG. 7. Such a feature permits a very compact switch assembly. Each of the apertures 42 is associated with a particular one of the wire gripping portions 51,56,62 of either the elongated movable switching elements 50,55 or a fixed switching element 60.

A better understanding of the relative positions of the switching elements may be had by referring to FIG. 8 which is taken along line 8—8 of FIG. 6. The lowest tier level on the rotary selector switch is shown to include the lower cam disc 47 having two axially aligned lobes 47*a* (one being back of the other as viewed in FIG. 8). A pair of elongated movable switching elements 55 of the linear type are placed in opposed relation on opposite sides of the cam disc 47. The elements 55 of FIG. 8 are in adjacent planes along the axis of the shaft 30. It can be seen that the pair of elements 55 are generally parallel to each other and are positioned for contact with the cam disc 47 at circumferential points spaced approximately 180 degrees from each other. The wire gripping end portions 56 of the elements 55 are loosely held in position within recesses 24 provided by the base member 20. Generally aligned with the wire gripping end portions 56 are corresponding apertures 42 through which the uninsulated ends of wires are pushed for lockable engagement with the wire gripping end portions 56 in a manner known in the art to effect connection of the switching elements 55 in circuit.

It can be seen that as the shaft 30 is rotated, the cam disc 47 having its lobes 47*a* will move and engage the intermediate cam portions 57 of the elements 55 wherein the moving contact portion 58 will engage and disengage from the opposed fixed switching elements 60, also connected in circuit by wire ends inserted into associated apertures 42 for locking electrical engagement with elements 60. The elements 60 bracket the end portion 58, which is spring-biased toward one of them. It is to be noted that while the lobes 47*a* as illustrated are axially aligned, such lobes could be offset from each other so as to provide switching of the elements 55 at different or identical rotational positions of the shaft 30.

Turning to FIG. 9, there is illustrated in further detail the middle or intermediate tier of the rotary selector switch according to the present invention. This tier includes the intermediate cam disc 46, which has two cam lobes 46a, 46b for engagement with generally opposed, elongated, movable switching elements 50 of the angled type. The elements 50 as illustrated in FIG. 9 are in generally nonparallel relation and contact points on the cam disc 36 that are circumferentially spaced from each other by less than 180 degrees. In a manner similar to that of the elements discussed earlier with regard to FIG. 8, the elements 50 as illustrated in FIG. 9 have their wire gripping end portions 51 fixed in position within recess 24 provided by the base member 20. A pair of apertures 42 receive non-insulated wire ends for engagement with the wire gripping end portions 51 of the element 50. As the cam disc 46 is rotated, the movable contact end 53 of the element 50 will engage and disengage from pairs of fixed switching elements 60 associated with each movable end 53. It is to be noted that the elements 50 and 55 lie in parallel planes spaced from each other as noted earlier, these planes being perpendicular to the axis of rotation of the shaft 30. It is also to be noted that the cam disc 46 having multiple lobes 46a, 46b can cause the moving contact end portion 53 to contact either one of the associated fixed elements 60 or the moving contact end portion 53 can be held by the cam 46 in position between the elements 60 in non-contacting relation wherein the switch comprised of such elements is in an open condition. It can further be seen with regard to FIG. 9, and also with regard to FIG. 8, that the configuration of the switching elements 50,55 is that of a third class lever with the wire gripping portions 51 constituting fulcrum points. Further, the elongated switching elements 50,55 extend substantially all the way across the base member 20.

Figure 10:
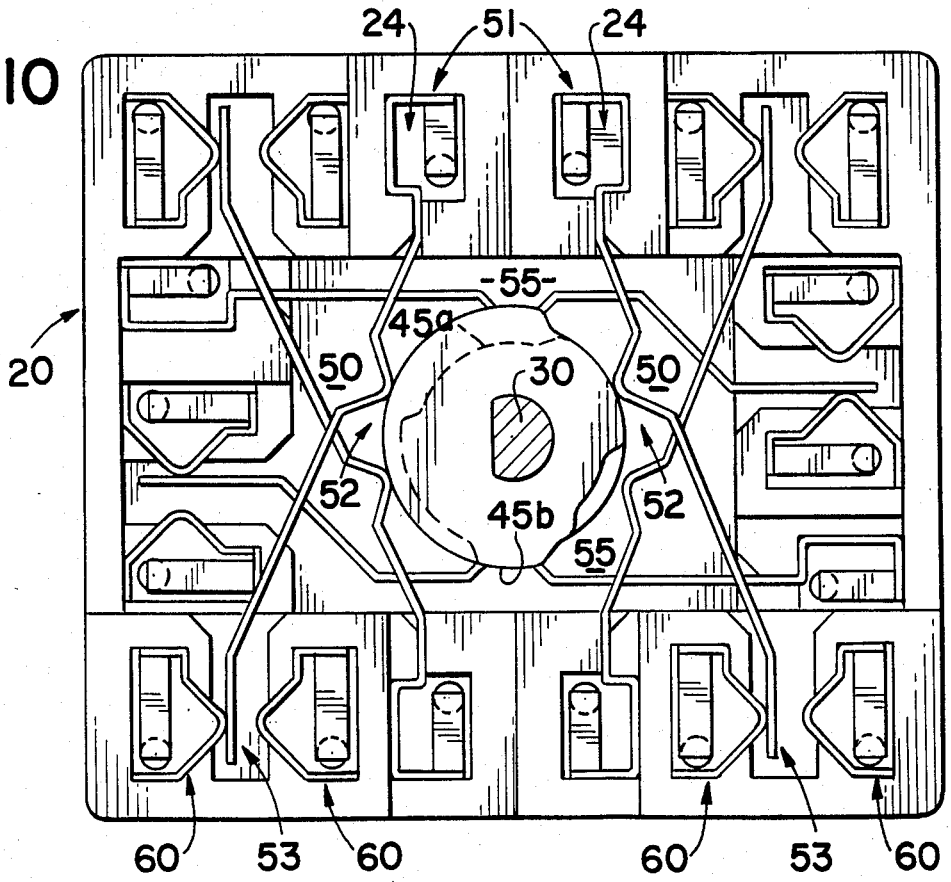
FIG. 10 is a top plan view of the selector switch of FIG. 6, taken along line 10—10 of FIG. 6.

With reference to FIG. 10, the upper tier level of the rotary selector switch of the present invention is more clearly illustrated, the upper level including the upper cam disc 45, which, like the cam discs 46,47 discussed and illustrated earlier, has multiple lobes, e.g., lobes 45a, 45b. The wire gripping end portions 51 of the pair of switching elements 50 contained in the upper tier level and engageable with the cam disc 45 are illustrated as being retained within appropriate recesses 24 provided by the base member 20. In a manner similar to that illustrated and discussed with regard to FIGS. 8 and 9, pairs of fixed switching elements 60 are associated with the movable contact end portions 53 of the elements 50 contained in the upper tier level.

FIG. 10 illustrates the relative positions of all six movable switching elements relative to each other. It can be seen that a single stack of cam discs 40 (see FIG. 1) can control six single-pole, double-throw switches, each of the switches being constituted by one of the elements 50,55 in association with a pair of the fixed switching elements 60. Use of both angular type movable elements 50 and linear type movable elements 55 allows maximum utilization of the space within the switch housing while maintaining proper spacing between all switching elements. Further, use of the spring-like elements 50,55,60, allows adequate wiping action at contact interface areas to ensure long contact life and reliability. It should also be noted that the switching elements 50,60 can be of the left-hand and right-hand type, as illustrated most clearly in FIG. 9. Although not illustrated, elements 55 could also be provided in left-hand and right-hand types if a particular switch configuration called for such elements. While a six-switch, six-position rotary selector switch is illustrated, it is to be understood that more or less switches and switch positions could be provided depending upon the application of the switch. It has also been demonstrated that a complex switch can be formed from a few relatively simple components. For example, a preselected number of cam discs can be stacked and oriented to program the switch in any manner desired. Further, only three basic types of switching elements, such as elements 50,55, and 60, need be provided. A switch of the type illustrated has been found to be highly reliable, easily assembled, and long-lived. Further, the switch is low in cost and can be quickly connected in circuit without special tools.

Although a preferred embodiment of this invention has been shown and described, it should be understood that various modifications and rearrangements of the parts may be resorted to without departing from the scope of the invention as disclosed and claimed herein.

What is claimed is:

1. A rotary selector switch comprising:

a rotatable shaft;

at least one cam member fixed to and carried on the shaft;

a switching means actuated by the cam member upon rotation of the shaft, the switching means including a plurality of fixed elements each having a terminal portion and an adjacent contact portion, and a plurality of elongated movable elements each having a terminal end portion and a contact end portion, the said end portion being located on opposite sides of said shaft and being interconnected by an intermediate cam follower portion engageable with and driven by the cam member, rotation of the cam member causing said contact portions of the fixed elements and said contact end portions of the movable elements to engage and disengage from each other at one or more predetermined rotational positions of the shaft, said terminal portions and said terminal end portions being circumferentially distributed about the axis of rotation of the shaft; and a casing rotationally supporting the shaft, the casing supporting said terminal portions of the fixed elements and said terminal end portions of the movable elements, said casing including at least two separate members between which are sandwiched portions of the switching means to retain the switching means in proper position relative to the cam member.

2. A rotary selector switch according to claim 1, wherein said casing is of boxlike rectangular configuration having a four-sided face along the peripheral edge of which said terminal portions and said terminal end portions are located for connection to an external circuit.

3. A rotary selector switch according to claim 2, wherein said terminal portions and said terminal end portions are located along all four sides of the peripheral edge of said face.

4. A rotary selector switch comprising:

a rotatable shaft;

at least one cam member fixed to and carried on the shaft;

a switching means actuated by the cam member upon rotation of the shaft, the switching means including at least one fixed element having a wire gripping portion and a contact portion, and at least one elongated movable element having a wire gripping end portion and a contact end portion, the end portions being interconnected by an intermediate cam follower portion engageable with and driven by the cam member, the movable element being configured as a third class lever with the wire gripping end portion being located generally at the lever fulcrum point, rotation of the cam member causing said contact portion of the fixed element and said contact end portion of the movable element to engage and disengage with each other at one or more predetermined rotational positions of the shaft; and a casing rotationally supporting the shaft, the casing providing a closed chamber for housing the cam member and the switching means, the casing including apertures generally at the locations of said wire gripping portions and said wire gripping end portions to permit the insertion of wire ends into the apertures for lockable engagement with the wire gripping portions and wire gripping end portions of the switch means, said casing including at least two separate members between which are sandwiched portions of the switch means to retain the switch means in proper position relative to the cam member.

5. A rotary selector switch according to claim 4, wherein the fixed element is constituted by a single piece of relatively thin metal deformed to provide said wire gripping portion and said contact portion, the metal having springlike characteristics to provide a limited degree of resiliency to said wire gripping portion and said contact portion.

6. A rotary selector switch according to claim 4, wherein the elongated movable element is constituted by a single narrow strip of relatively thin metal deformed to provide the wire gripping end portion, the contact end portion, and the cam follower portion, the metal having springlike characteristics to provide a limited degree of resiliency to the movable element.

7. A rotary selector switch comprising:

a rotatable shaft;

at least one multilobed cam disc coaxially mounted on and rotationally fixed to the shaft, the disc lying in a plane perpendicular to the rotational axis of the shaft;

a switching means actuated by the lobes of the cam disc upon rotation of the shaft, the switching means including a pair of elongated movable elements each having a wire gripping end portion and a contact end portion, the end portions being interconnected by an intermediate cam follower portion engageable with and driven by the lobes of the cam disc, each movable element being configured as a third class lever with its wire gripping end portion being located generally at the lever fulcrum point, the elongated movable elements lying in planes parallel to said plane in which the disc lies, the switching means further including fixed elements each having a wire gripping portion and a contact portion, the fixed elements being located at and adjacent to the contact end portions of the movable elements wherein rotation of the cam disc causes said contact portions of the fixed elements and said contact end portions of the movable elements to engage and disengage with each other at predetermined rotational positions of the shaft; and a casing having a base member and a cover member, the members interlocking to provide a closed chamber for housing the cam disc and the switching means, one end of the shaft being journaled for rotation in the base member, the other end of the shaft extending through a bushinglike aperture in the cover member, the switching means being held in position relative to the cam disc solely by portions of the base and cover members between which portions of the switching means are sandwiched, the base member providing a plurality of apertures at the locations of the wire gripping portions and wire gripping end portion of the switch means to permit the insertion of wire ends into the aperture through said base member for lockable engagement with the wire gripping portions and wire gripping end portions.

8. A rotary selector switch according to claim 7, wherein the base member includes recesses receiving the wire gripping portions and wire gripping end portions of the switch means, abutting portions of the cover member engaging the wire gripping portions and wire gripping end portions to hold them in position within their respective recesses provided by the base member.

9. A rotary selector switch according to claim 7, wherein the intermediate cam follower portions of the pair of moving elements engage the cam lobes at circumferential points on the cam disc circumferentially spaced from each other by approximately 180 degrees.

10. A rotary selector switch according to claim 7, wherein the elongated movable elements are generally parallel to each other.

11. A rotary selector switch according to claim 7, wherein the intermediate cam follower portions of the pair of moving elements engage the cam disc lobes at circumferential points on the cam disc circumferentially spaced from each other by less than 180 degrees.

12. A rotary selector switch according to claim 11, wherein the elongated movable elements are generally non-parallel to each other.

13. A rotary selector switch comprising:

a rotatable shaft;

a stack of multilobed cam discs coaxially mounted on and rotationally fixed to the shaft, the discs lying in parallel planes perpendicular to the rotational axis of the shaft;

a pair of single-pole switches associated with and actuated by each cam disc, each single-pole switch lying in a plane parallel to the plane of its associated disc, no two single-pole switches lying in the same plane, each single-pole switch including a thin, narrow strip of copperbased metal deformed to provide a moving element having a wire gripping end portion and a contact end portion, the end portions being interconnected by an intermediate cam follower portion engageable with the lobes of its associated cam disc, the moving element being configured as a third class lever, the terminal gripping end portion being located generally at the lever fulcrum point, the single-pole switch further including at least one fixed element formed from a single thin piece of copper-based metal deformed to provide a wire gripping portion and a contact portion, the fixed element being located adjacent to the contact end portion of the associated moving element wherein the contact end portion of the moving element and the contact portion of the fixed element engage and disengage with each other at predetermined rotational positions of the shaft; and a boxlike casing providing a closed chamber for housing said cam disc stack and said single-pole switches, said casing including apertures permitting wire ends to lockably engage said wire gripping portions and said wire gripping end portions via said apertures, said casing including at least two separate members between which are sandwiched portions of the switch means to retain the switch means in proper position relative to the cam member.

14. A rotary selector switch according to claims 4, 7, or 13, wherein each said intermediate cam follower portion extends completely across said closed chamber, said wire gripping portions and said wire gripping end portions being spaced about the periphery of the closed chamber.

* * * * *